US010280575B2

(12) United States Patent
Peng et al.

(10) Patent No.: US 10,280,575 B2
(45) Date of Patent: May 7, 2019

(54) CABLE-STAYED SUSPENSION BRIDGE STRUCTURE SUITABLE FOR SUPER LONG SPANS

(71) Applicant: CCCC SECOND HIGHWAY CONSULTANT CO., LTD., Wuhan, Hubei (CN)

(72) Inventors: Yuancheng Peng, Wuhan (CN); Zhongsheng Yang, Wuhan (CN); Chulong Chen, Wuhan (CN)

(73) Assignee: CCCC SECOND HIGHWAY CONSULTANT CO. LTD., Wuhan (CN)

( * ) Notice: Subject to any disclaimer, the term of this patent is extended or adjusted under 35 U.S.C. 154(b) by 0 days.

(21) Appl. No.: 15/945,262

(22) Filed: Apr. 4, 2018

(65) Prior Publication Data

US 2018/0291569 A1 Oct. 11, 2018

(30) Foreign Application Priority Data

Apr. 7, 2017 (CN) ..... 2017 1 0224054
Apr. 7, 2017 (CN) ..... 2017 2 0363342 U

(51) Int. Cl.

| | |
|---|---|
| ***E01D 11/00*** | (2006.01) |
| ***E01D 11/04*** | (2006.01) |
| ***E01D 2/04*** | (2006.01) |
| ***E01D 19/14*** | (2006.01) |
| *E01D 101/30* | (2006.01) |
| *E02D 27/42* | (2006.01) |
| *E02D 5/22* | (2006.01) |

(52) U.S. Cl.
CPC ..... *E01D 11/04* (2013.01); *E01D 2/04* (2013.01); *E01D 19/14* (2013.01); *E01D 2101/30* (2013.01); *E02D 5/22* (2013.01); *E02D 27/42* (2013.01)

(58) Field of Classification Search
CPC ..... E01D 2/04; E01D 11/04; E01D 19/14; E01D 2101/30; E02D 5/22; E02D 27/42
USPC ..... 14/18–25
See application file for complete search history.

(56) References Cited

U.S. PATENT DOCUMENTS 417,054 A * 12/1889 Little ..... E01D 11/00 14/21
430,428 A * 6/1890 Lindenthal ..... E01D 11/00 14/21

(Continued)

FOREIGN PATENT DOCUMENTS

CN 101424071 A 5/2009
CN 104452572 A 3/2015

(Continued)

*Primary Examiner* — Raymond W Addie
(74) *Attorney, Agent, or Firm* — Oliff PLC

(57) ABSTRACT

A cable-stayed suspension bridge structure suitable for super long spans by comprising a horizontally arranged main bridge main beam, wherein vertical main towers are arranged at ends of the main bridge main beam, and each main tower is anchored by stay cables; a main bridge vertical support and a longitudinal elastic damping stopper are arranged at positions of the main bridge main beam close to the main tower, and the main beam is kept stable longitudinally by virtue of the geometric stiffness of the cable force of the stay cable and the longitudinal elastic damping stopper.

11 Claims, 5 Drawing Sheets

(56) References Cited

U.S. PATENT DOCUMENTS

| | | | | | |
|---|---|---|---|---|---|
| 438,070 | A * | 10/1890 | Eddy | E01D 11/00 14/21 |
| 513,389 | A * | 1/1894 | Greer | E01D 11/04 14/21 |
| 605,153 | A * | 6/1898 | Waddell et al. | E01D 11/02 14/21 |
| 625,902 | A * | 5/1899 | Rieppel | E01D 11/00 14/21 |
| 629,935 | A * | 8/1899 | Surgis | E01D 11/00 14/21 |
| 630,809 | A * | 8/1899 | Gunn | E01D 11/00 14/21 |
| 691,982 | A * | 1/1902 | Sturgis | E01D 11/00 14/21 |
| 729,016 | A * | 5/1903 | Tomlinson | E01D 11/00 14/21 |
| 804,744 | A * | 11/1905 | Lindenthal | E01D 11/02 14/21 |
| 6,530,101 | B1 * | 3/2003 | Nottingham | E01D 11/00 14/20 |
| 2012/0216357 | A1 * | 8/2012 | Byun | E01D 11/04 14/77.1 |

FOREIGN PATENT DOCUMENTS

| | | | |
|---|---|---|---|
| CN | 106012797 | A | 10/2016 |
| CN | 106498837 | A | 3/2017 |
| CN | 206721646 | U | 12/2017 |

* cited by examiner

CABLE-STAYED SUSPENSION BRIDGE STRUCTURE SUITABLE FOR SUPER LONG SPANS

FIELD OF THE INVENTION

The present invention relates to the technical field of civil engineering bridges, and more particularly to a cable-stayed suspension bridge structure suitable for super long spans, which realizes a new suspension bridge structure with greater spanning capability and better economical efficiency.

BACKGROUND OF THE INVENTION

Bridges are structures for crossing various barriers (e.g., rivers or other structures) on roads, railways, urban roads, rural roads and water conservancy. Based on structural stress characteristics, the bridge can be divided into beams, arches, rigid frames and a hanging and combination system. A hanging bridge, also known as a suspension bridge, is a bridge using a cable or chain bearing the tension as the main load bearing member, and is composed of a suspension cable, a cable tower, an anchorage, a suspender, a bridge deck system and the like. The main load bearing member of the suspension bridge is the suspension cable, which mainly bears the tension and is generally made of steel with high tensile strength (steel wires, steel cables or the like). As the traditional suspension bridge can take full advantage of the strength of the material, and has the characteristics of material saving and light weight, thus it has the highest spanning capability among a variety of system bridges, and its span can reach 1000-2000 m.

Although the span of the suspension bridge has improved dramatically, overall, the current traditional suspension bridge has the following deficiencies: (1) the rigidity is small; (2) the deformation is relatively large; (3) the stability against wind is poor; (4) the down-warping of the main suspension cable can reach 10 m; (5) the construction cost is relatively high; and (6) 2000 m is the current limit span, and the span needs to be further improved.

Therefore, it is of a great practical value to develop a suspension bridge structure form that meets the requirements of greater spanning capability, higher utilization of materials, more reasonable stress of the structure, and better economical efficiency.

SUMMARY OF THE INVENTION

The objective of the present invention is to provide a cable-stayed suspension bridge structure suitable for super long spans, which combines the advantages of a suspension bridge and a cable-stayed bridge, improves the span and the bearing efficiency of the suspension bridge structure in terms of the structural system and inherent stress mechanism and overcomes the problems of small stiffness, large deformation, poor stability and limited spanning capability of the traditional suspension bridge.

In order to achieve the above objective, the present invention provides a cable-stayed suspension bridge structure suitable for super long spans, including a horizontally arranged main bridge main beam, wherein vertical main towers are arranged at ends of the main bridge main beam, and each main tower is anchored by stay cables; a main bridge vertical support and a longitudinal elastic damping stopper are arranged at positions of the main bridge main beam close to the main tower, and the main beam is kept stable longitudinally by virtue of the geometric stiffness of the cable force of the stay cable and the longitudinal elastic damping stopper.

Further, the main towers can be divided into edge main towers and middle main towers according to the structural system, and a single-span structural system is formed when there are only two edge main towers; and a multi-span system is formed when there are two edge main towers and one or more middle main tower.

Further, one end of the stay cable of the middle main tower is anchored to the main tower, and the other end thereof is anchored to the main beam; one end of a main span stay cable of the edge main tower is anchored to the main tower, and the other end thereof is anchored to the main beam; and one end of an anchor span stay cable of the edge main tower is anchored to the main tower, and the other end thereof is anchored to distributed ground anchors.

The edge main tower is kept stable by virtue of the main span stay cable on one side and the anchor span stay cable anchored to the ground anchors on the other side; and in the multi-span system, the middle main tower is kept stable by virtue of the main span stay cables on two sides.

Further, the main bridge vertical support can also be arranged in the main span or penetrate through the main tower to form a continuous structure.

Further, the main beam is suspended by the main span stay cable, and the main bridge vertical support and the longitudinal elastic damping stopper are arranged in the vicinity of the main tower, which is equivalent to a simply supported beam supported by the stay cable, and the longitudinal stability is kept by virtue of the geometric stiffness of the cable force of the stay cable and the longitudinal elastic damping stopper.

Further, the horizontal components of the main span stay cables of the adjacent main towers keep the overall balance in the main beam, and the main beam only generates an axial tensile force but no axial pressure due to the stay cables, thereby improving the natural vibration frequency of the structure, and thus solving the problem of pressure-resistant stability of the main beam with the super long span.

Further, the main beam is generally a steel box beam or a steel truss with relatively high tensile strength.

Further, a foundation and a pile cap are arranged at the bottom of the main tower, the foundation is arranged underground in a foundation layer with proper engineering geology, and the pile cap is located between the foundation and the main tower and is connected into an entirety with the top of the foundation and the bottom of the main tower.

Further, the foundation, the pile cap, the main tower, the stay cable, the main bridge main beam, the ground anchors, the main bridge vertical support and the longitudinal elastic damping stopper form a cable-stayed suspension bridge structure suitable for super long spans.

Further, the edge main tower is provided with an approach bridge support and a main bridge vertical support for respectively supporting an approach bridge main beam and the main bridge main beam on two sides; and the middle main tower is provided with a main bridge vertical support for respectively supporting the main bridge main beams on two sides.

Compared with the prior art, the present invention has the following advantages:

(1) as compared with an equivalent-span suspension bridge, the advantages of a cable-stayed bridge are maintained and the load bearing rigidity is greater;

(2) as compared with an equivalent-span cable-stayed bridge, the main beam has a higher vibration frequency due to tension, so that it has better flutter stability under wind and stronger wind resistance, and is much better than that of the suspension bridge, meanwhile, the main beam does not bear the pressure, thereby solving the problem of pressure-resistant stability of the main beam with the super long span;

(3) the main beam needs no sidespan to balance the axial force, and the steel main beam can be only set in the main span or even an area of the main span, thereby reducing the construction cost;

(4) the main beam is equivalent to a multi-point elastic simply supported beam supported by the stay cable, the temperature expansion and contraction structure of the beam body is arranged at a vertical support, the stress is better than that of the expansion and contraction structure of a multi-tower cable-stayed bridge or partially ground-anchored cable-stayed bridge in the span, the expansion is not accumulated in the case of multi-tower multi-span, and thus being suitable for bridges spanning wide straits and estuaries; and (5) the structural system of the novel cable-stayed suspension bridge solves the problem of the pressure-resistant stability of a main beam in a cable-stayed bridge with a similar system, which is conducive to using an ultra-high performance material for the main beam, a good prospect is provided for achieving the bridge with the super long span, and the theoretical spanning capability meets or even exceeds that of the conventional suspension bridge, and is initially estimated up to 3000 m to 5000 m.

BRIEF DESCRIPTION OF THE DRAWINGS

To illustrate technical solutions in the embodiments of the present invention or in the prior art more clearly, a brief introduction on the accompanying drawings which are needed in the description of the embodiments or the prior art is given below. Apparently, the accompanying drawings in the description below are merely some of the embodiments of the present invention, based on which other accompanying drawings can be obtained by those of ordinary skill in the art without any creative effort.

REFERENCE SIGNS

Figure 1:
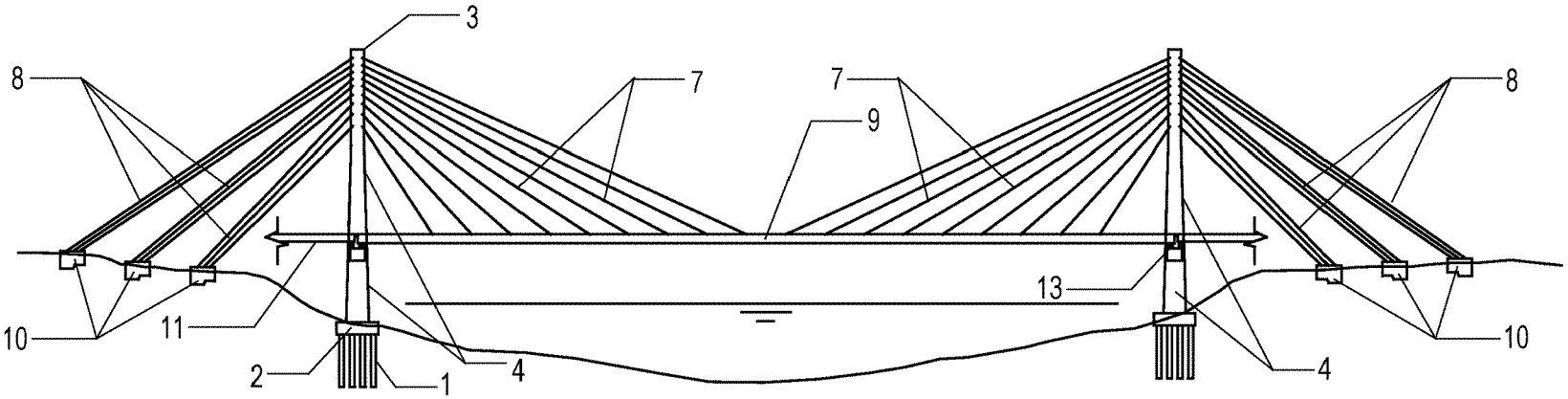
FIG. 1 is a schematic diagram of double-tower single-span of a cable-stayed suspension bridge structure suitable for super long spans.

1—foundation, 2—pile cap, 3—main tower, 4—edge main tower, 5—middle main tower, 6—stay cable, 7—main span stay cable, 8—anchor span stay cable, 9—main bridge main beam, 10—ground anchor, 11—approach bridge main beam, 12—approach bridge support, 13—main bridge vertical support, 14—longitudinal elastic damping stopper, 15—steel box beam, 16—steel truss, 17—support structure.

DETAILED DESCRIPTION OF THE EMBODIMENTS

It should be noted that the following detailed description is exemplary and intended to provide further explanation of the present application. Unless defined otherwise, all technical and scientific terms used herein have the same meaning as commonly understood by those of ordinary skill in the art to which this application belongs.

It should be noted that the terminology used herein is for the purpose of describing specific embodiments only, and is not intended to limit the exemplary embodiments according to the present application. As used herein, the singular forms are also intended to include the plural forms, unless the context clearly indicates otherwise, and further it should also be understood that the terms "comprises" and/or "includes" when used in this specification specify the existence of features, steps, operations, devices, components, and/or combinations thereof.

As described in the background art, the prior art has the following problems: (1) the rigidity is small; (2) the deformation is relatively large; (3) the stability against wind is poor; (4) the down-warping of the main suspension cable can reach more than 10 m; (5) the construction cost is relatively high; and (6) 2000 m is the current limit span, and the span needs to be further improved. In order to solve the above technical problems, the present application provides a cable-stayed suspension bridge structure suitable for super long spans.

The structure of the present invention will be further described below in conjunction with the accompanying drawings.

The present invention provides a cable-stayed suspension bridge structure suitable for super long spans, which has better spanning capability, higher material utilization rate, more reasonable structure stress and better economical efficiency than the traditional suspension bridge and cable-stayed bridge. The cable-stayed suspension bridge structure includes a horizontally arranged main bridge main beam, vertical main towers are arranged at ends of the main bridge main beam, and a stay cable is arranged at the upper part of each main tower; one end of a main span stay cable is anchored to the main tower, and the other end is anchored to the main beam; one end of an anchor span stay cable is anchored to the main tower, and the other end thereof is anchored to distributed ground anchors; and a main bridge vertical support and a longitudinal elastic damping stopper are arranged at positions of the main bridge main beam close to the main tower, and the main bridge vertical support can also be arranged in the main span or penetrate through the main tower to form a continuous structure.

The main beam is suspended by the main span stay cable, and the main bridge vertical support and the longitudinal elastic damping stopper are arranged in the vicinity of the main tower, which is equivalent to a simply supported beam supported by the stay cable, and the longitudinal stability is kept by virtue of the geometric stiffness of the cable force of the stay cable and the longitudinal elastic damping stopper.

The horizontal components of the stay cables of the adjacent main towers keep the overall balance in the main beam, and the main beam only generates an axial tensile force but no axial pressure due to the stay cables, thereby improving the natural vibration frequency of the structure, and thus solving the problem of pressure-resistant stability of the main beam with the super long span and being suitable for a bridge structure with a super long span.

Specifically as shown in FIGS. 1 to 5, a cable-stayed suspension bridge structure suitable for super long spans is composed of foundations 1, pile caps 2, main towers 3, stay cables 6, a main bridge main beam 9, ground anchors 10, main bridge vertical supports 13 and longitudinal elastic damping stoppers 14.

Figure 2:
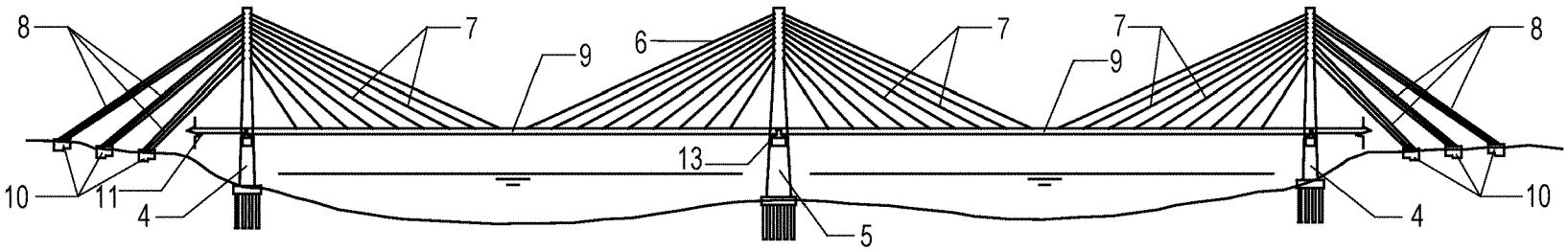
FIG. 2 is a schematic diagram of multi-tower multi-span of a cable-stayed suspension bridge structure suitable for super long spans.

As shown in FIGS. 1 and 2, the main towers 3 can be divided into edge main towers 4 and middle main towers 5 according to the structural system, and a single-span structural system is formed when there are only two edge main towers 4; and a multi-span system is formed when there are two edge main towers 4 and one or more middle main tower 5.

As shown in FIGS. 1 and 2, the edge main tower 4 is kept stable by virtue of a main span stay cable 7 on one side and an anchor span stay cable 8 anchored to the ground anchors on the other side; and in the multi-span system, the middle main tower 5 is kept stable by virtue of the main span stay cables 7 on two sides.

As shown in FIGS. 1 and 2, the foundation 1 and the pile cap 2 are arranged at the bottom of the main tower, the foundation 1 is arranged underground in a foundation layer with proper engineering geology, and the pile cap 2 is located between the foundation 1 and the main tower 3 and is connected into an entirety with the top of the foundation 1 and the bottom of the main tower 3.

Figure 3:
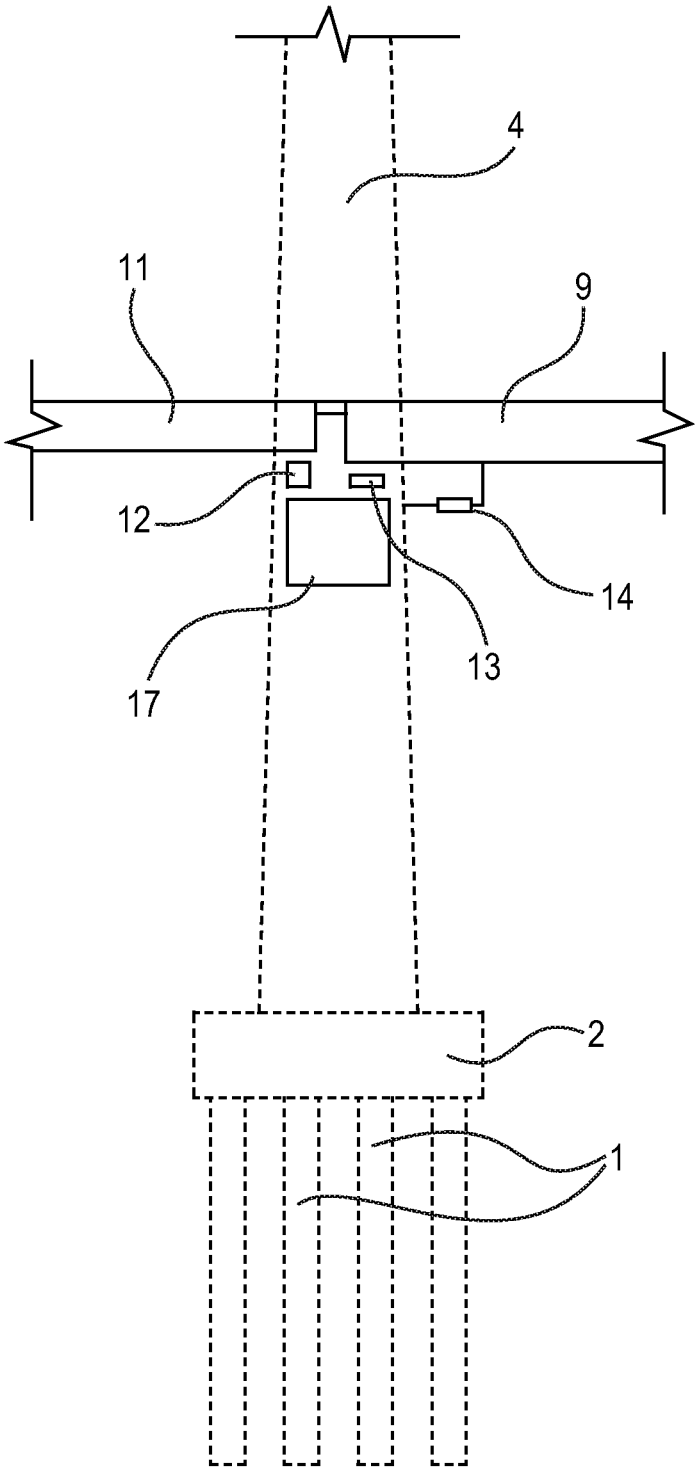
FIG. 3 is a partial schematic diagram of an edge main tower support part.
Figure 4:
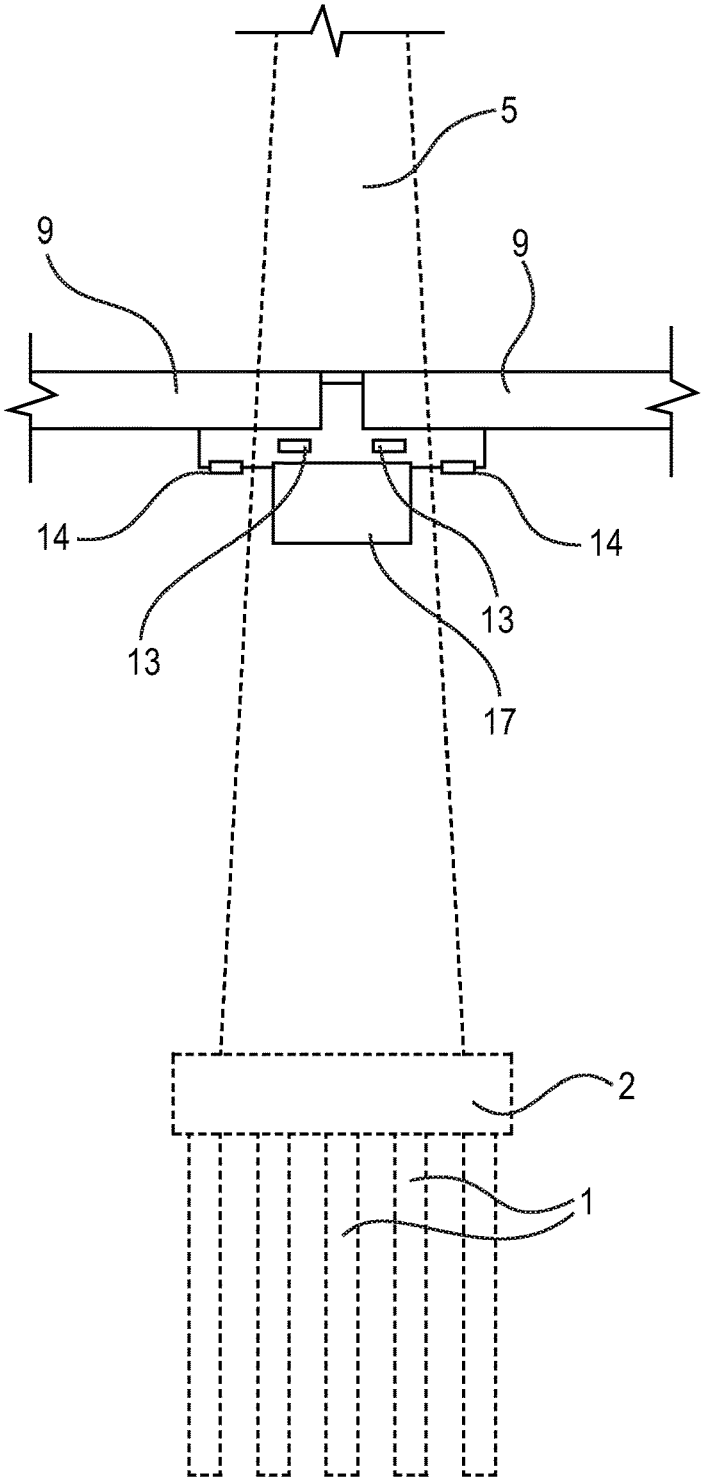
FIG. 4 is a partial schematic diagram of a middle main tower support part.

As shown in FIGS. 3 and 4, the edge main tower 4 is provided with an approach bridge support 12 and a main bridge vertical support 13 for respectively supporting an approach bridge main beam 11 and the main bridge main beam 9 on two sides; and the middle main tower 5 is provided with a main bridge vertical support 13 for respectively supporting the main bridge main beams 9 two sides. Support structures 17 support the vertical supports 12 and 13 relative to the main towers.

Figure 5A:
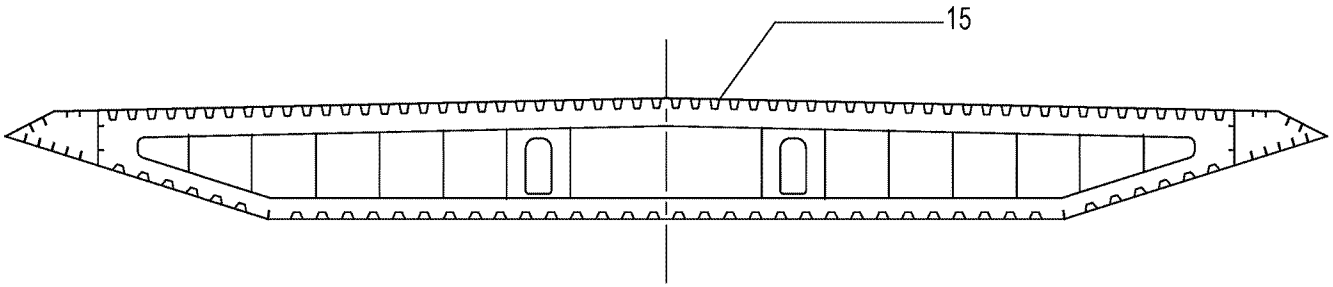
FIGS. 5A and 5B are structural schematic diagrams of a main beam.
Figure 5B:
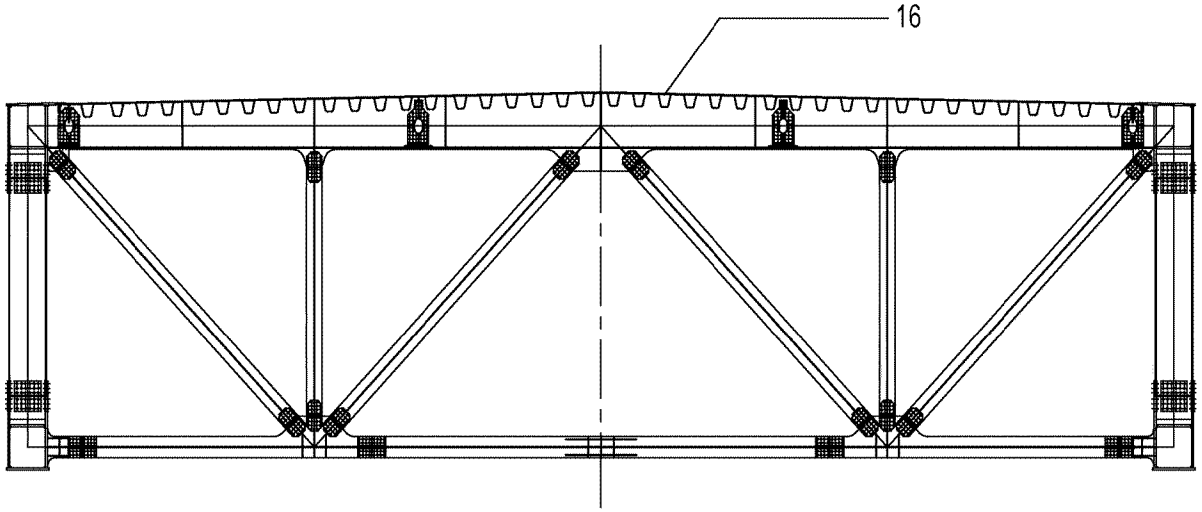

As shown in FIG. 5, the main bridge main beam 9 is generally a steel box beam 15 or a steel truss 16 with relatively high tensile strength.

It can be seen from the above description that the above embodiments of the present application achieve the following technical effects:

(1) as compared with an equivalent-span suspension bridge, the advantages of a cable-stayed bridge are maintained and the load bearing rigidity is greater;

(2) as compared with an equivalent-span cable-stayed bridge, the main beam has a higher vibration frequency due to tension, so that it has better flutter stability under wind and stronger wind resistance, and is much better than that of the suspension bridge;

(3) the main beam needs no sidespan to balance the axial force, and the steel main beam can be only set in the main span or even an area of the main span, thereby reducing the construction cost;

(4) the main beam is equivalent to a multi-point elastic simply supported beam supported by the stay cable, the temperature expansion and contraction structure of the beam body is arranged at a vertical support, the stress is better than that of the expansion and contraction structure of a multi-tower cable-stayed bridge or partially ground-anchored cable-stayed bridge in the span, the expansion is not accumulated in the case of multi-tower multi-span, and thus being suitable for bridges spanning wide straits and estuaries; and (5) the structural system of the novel cable-stayed suspension bridge solves the problem of the pressure-resistant stability of a main beam in a cable-stayed bridge with a similar system, which is conducive to using an ultra-high performance material for the main beam, a good prospect is provided for achieving the bridge with the super long span, and the theoretical spanning capability meets or even exceeds that of the conventional suspension bridge, and is initially estimated up to 3000 m to 5000 m.

Although the specific embodiments of the present invention have been described above in conjunction with the accompanying drawings, it is not intended to limit the protection scope of the present invention. Those skilled in the art should understand that, based on the technical solutions of the present invention, various modifications or variations made by those skilled in the art without any creative work still fall within the protection scope of the present invention.

The invention claimed is:

1. A cable-stayed suspension bridge structure suitable for super long spans, comprising a horizontally arranged main bridge main beam, wherein vertical main towers are arranged at ends of the main bridge main beam, and each main tower is anchored by stay cables; each end of the main bridge main beam is supported by a main bridge vertical support; longitudinal elastic dampers are arranged at positions between the main bridge main beam and support structures of each main tower, the support structures support the main bridge vertical supports relative to the main towers; and the main beam is kept stable longitudinally by virtue of the geometric stiffness of the cable force of the stay cable and the longitudinal elastic dampers.

2. The cable-stayed suspension bridge structure suitable for super long spans of claim 1, wherein when the main towers comprise two edge main towers and one or more middle main towers, a multi-span system is formed.

3. The cable-stayed suspension bridge structure suitable for super long spans of claim 1, wherein the main beam is generally a steel box beam or a steel truss with relatively high tensile strength.

4. The cable-stayed suspension bridge structure suitable for super long spans of claim 1, wherein a foundation and a pile cap are arranged at the bottom of the main tower, the foundation is arranged underground in a foundation layer, and the pile cap is located between the foundation and the main tower and is connected into an entirety with the top of the foundation and the bottom of the main tower.

5. The cable-stayed suspension bridge structure suitable for super long spans of claim 1, wherein when the main towers only comprise two edge main towers, a single-span structural system is formed.

6. The cable-stayed suspension bridge structure suitable for super long spans of claim 5, wherein the edge main tower is provided with an approach bridge support and a main bridge vertical support for respectively supporting an approach bridge main beam and the main bridge main beam on two sides.

7. The cable-stayed suspension bridge structure suitable for super long spans of claim 3, wherein the middle main tower is provided with a main bridge vertical support for respectively supporting the main bridge main beams on two sides.

8. The cable-stayed suspension bridge structure suitable for super long spans of claim 2, wherein one end of the stay cable of the middle main tower is anchored to the main tower, and the other end thereof is anchored to the main beam; one end of a main span stay cable of the edge main tower is anchored to the main tower, and the other end thereof is anchored to the main beam; and one end of an anchor span stay cable of the edge main tower is anchored to the main tower, and the other end thereof is anchored to distributed ground anchors.

9. The cable-stayed suspension bridge structure suitable for super long spans of claim 5, wherein the main bridge vertical support is also arranged in the main span or penetrates through the main tower to form a continuous structure.

10. The cable-stayed suspension bridge structure suitable for super long spans of claim 2, wherein the edge main tower is provided with an approach bridge support and a main bridge vertical support for respectively supporting an approach bridge main beam and the main bridge main beam on two sides.

11. The cable-stayed suspension bridge structure suitable for super long spans of claim 2, wherein the main bridge vertical support is also arranged in the main span or penetrates through the main tower to form a continuous structure.

* * * * *